United States Patent [19]

Simon

[11] Patent Number: 4,674,664

[45] Date of Patent: Jun. 23, 1987

[54] BACKSACK

[76] Inventor: Jonathan D. Simon, 305 Riverside Dr., 12-C, New York, N.Y. 10025

[21] Appl. No.: 814,965

[22] Filed: Dec. 31, 1985

[51] Int. Cl.[4] ..... A45F 3/04

[52] U.S. Cl. ..... 224/215; 224/153; 383/72

[58] Field of Search ..... 224/151, 153, 154, 209, 224/215, 259, 211; 383/72, 73

[56] References Cited

U.S. PATENT DOCUMENTS

| | | | |
|---|---|---|---|
| 403,928 | 5/1889 | Emeric | 383/73 |
| 467,108 | 1/1892 | Cussen | 383/73 |
| 931,627 | 8/1909 | Lazarovich-Hrebelianovich | 224/219 |
| 1,095,790 | 5/1914 | Blumel | 383/73 X |
| 2,552,443 | 5/1951 | Molnari | 224/151 |
| 2,678,672 | 7/1951 | Spilman | 383/73 |
| 4,332,379 | 6/1982 | Bannister | 224/215 X |

*Primary Examiner*—Stephen Marcus
*Assistant Examiner*—David Voorhees
*Attorney, Agent, or Firm*—Dennison, Meserole, Pollack & Scheiner

[57] ABSTRACT

A backsack including a flexible pouch with an open upper end, and an opposed pair of shoulder straps. The shoulder straps comprise elongate cords looped about the open end of the pouch in opposite directions for a contraction of the open end and a closing of the pouch upon an outward pull on the straps. The looped cords are engaged through apertures at the closed bottom of the pouch, each cord extending beyond the corresponding aperture and forming a waist strap.

7 Claims, 5 Drawing Figures

BACKSACK

BACKGROUND OF THE INVENTION

The use of back-mounted packs, normally simply referred to as backpacks, is widespread and used in a varity of situations from hikers with massive packs to school children with back-mounted bookbags.

The known backpacks, while providing a highly efficient means for carrying goods, and at the same time freeing the arms and hands of the user, are rather cumbersome devices not readily adapted for carrying small loads or for use in situations where mobility and maneuverability are essential, such as in jogging, bicycling and skiing.

Further, the conventional backpack requires particular care in the use and mounting thereof. For example, the closure means for securing the contents of the pack normally uses several straps, or similar fasteners, which must be individually fastened. In addition, assuming the backpack is of the type incorporating arm and shoulder receiving slings, these must be individually adjusted. Finally, for a stabilization of the pack, separately adjustable waist straps are frequently provided.

Another common form of carrier comprises a flexible sack or bag with some form of drawstring closure wherein the drawstring or strings can be used to carry the bag by hand. An example of such a bag which can be carried over the shoulder is illustrated in U.S. Pat. No. 2,552,443, issued to J. Molinari on May 8, 1951. In this patent, the single double-strand drawstring used to close the bag is also secured to the closed opposite end of the bag and defines a single shoulder strap or sling whereby the bag can be suspended over one shoulder of the user much in the manner of a conventional pocketbook. However, the Molinari bag, positioned by a single shoulder strap, will be free to move and shift substantially at will unless, as suggested in FIG. 4 of Molinari, specifically stabilized by the hand of the wearer. Similarly, any separating of the strands in Molinari will tend to open the bag.

SUMMARY OF THE INVENTION

The backsack of the present invention is particularly adapted to provide a compact securely mounted back container which is both lightweight and capable of closely nesting to the body.

It is also a significant feature of the invention that the backsack be so constructed whereby the open loading and thereof automatically close upon a mounting of the backsack and effectively remain closed until such time as the backsack is removed. A further feature of the invention involves the provision of combined shoulder straps and waistlines whereby an adjustment and tying of the waistlines will effect a simultaneous adjustment of the shoulder straps which in turn maintain the closure sealed.

Basicaly, the backsack of the invention includes a lightweight pouch, preferably of loose knit nylon, of a completely flexible and highly compressible nature. The pouch, in the illustrated form, includes front and rear panels sealed at the sides and bottom and open at the top, defining in effect a sack with a peripheral wall, closed bottom and open loading top.

It is contemplated that the outer face of the front panel be provided with a snap-closed pocket therein. A similar pocket may be included on the inner face of the back panel within the pouch itself.

A pair of shoulder straps are provided, preferably of nylon cord for combined strength and lightweight. Each strap is formed into a loop slidably received within a sleeve defined along the top edge of the peripheral wall about the top opening. This sleeve will be made by reversely returning the top edge and stitching or otherwise securing the edge to define the cord receiving configuration. The looped cords of the two straps extend in opposite directions about the top of the pouch and project through openings in the confining sleeve. The free ends of the loops, beyond the sleeve, extending downwardly and through grommeted holes in the lower corners of the pouch at the opposite ends of the closed bottom. Each cord, beyond the corresponding grommeted hole, is knotted whereby retraction through the hole or aperture is precluded. At the same time, an outward drawing of the knotted ends can be effected for a tightening of the sling portion of each strap through which the arm and shoulder is introduced.

One end of the cord is continued to define a waist strap or cord with the two waist straps tying about the waist of the user and thus both anchoring the bottom of the flexible pouch and firmly drawing the sling portions of the shoulder straps and the pouch itself into snug conformity with the body. Such a mounting of the backsack will effect an automatic closure of the open top by contracting the upper flexible portion of the peripheral wall. The actual initial closure of the pouch can be effected by merely an outward drawing of the shoulder straps relative to each other. This can be done simultaneously with a mounting of the backsack on the back in that any tendency to elongate the shoulder straps for the introduction of the arms can only be effected by a simultaneous contracting of the open top of the bag as withdrawal of the shoulder straps through the bottom apertures is limited by the restrictive knots provided thereon.

Other features and advantages of the invention will become apparent from the following more detailed description of the invention.

DESCRIPTION OF PREFERRED EMBODIMENT

Figure 1:
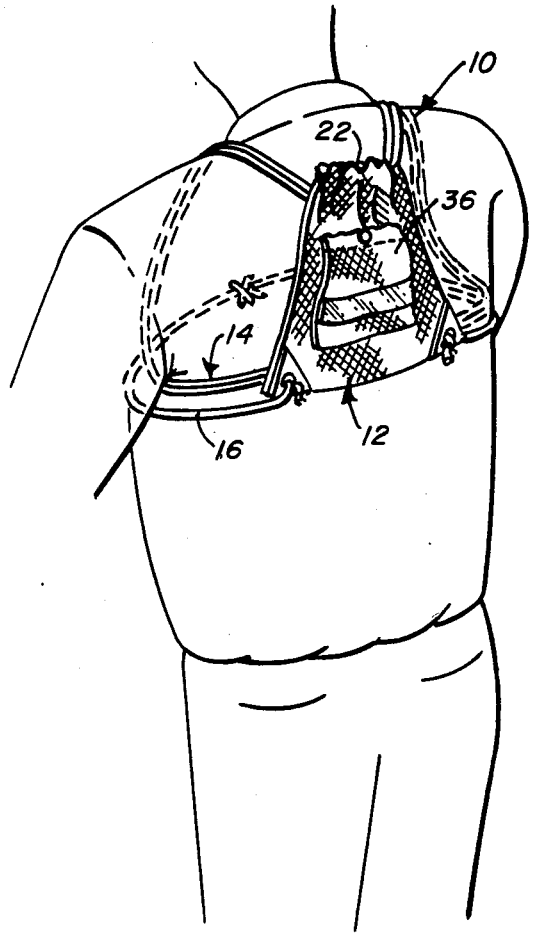
FIG. 1 is a perspective view of the backsack of the invention mounted on a user.

Referring now more specifically to the drawings, reference numeral 10 is used to designate the backsack comprising the present invention. The backsack 10 includes a flexible pouch 12 and an opposed pair of shoulder straps 14 with waist straps 16 as extensions thereof.

The pouch 12 is preferably of a strong lightweight material such as nylon knit and includes a peripheral wall 18, closed bottom 20 and open top 22. As illustrated, the pouch can be formed of front and rear panels 24 and 26 stitched or otherwise sealed along the bottom and opposed side edges.

The lower corners 28 of the pouch 12, to the opposite ends of the closed bottom 20, are reinforced, by appropriate triangular gussets or the like, and provided with transverse grommet-reinforced apertures 30 therethrough.

The upper edges of the flexible peripheral wall 18 is reversely turned about the open top 22 and secured, as by stitching or the like, to define a retaining sleeve 32. This sleeve 32, at diammetrically opposed points corresponding to the side edges of the pouch 12, is open, as indicated at 34, to accommodate the closure means as shall be described subsequently.

It is contemplated that an internal upwardly opening pocket 36, with a fastener of interengaging hooks and eyes such as Velcro, be provided on the inner face of the rear panel 26. An enlarged upwardly opening external pocket 38 is also provided on the outer face of the front panel 24. This pocket 38 will normally have an appropriate snap closure 40 for the open upper end thereof. As desired, and as a safety feature, reflective tape 42 may be provided across the outer face of the pocket 38, or for that matter, across any exposed portion of the pouch 12.

Figure 5:
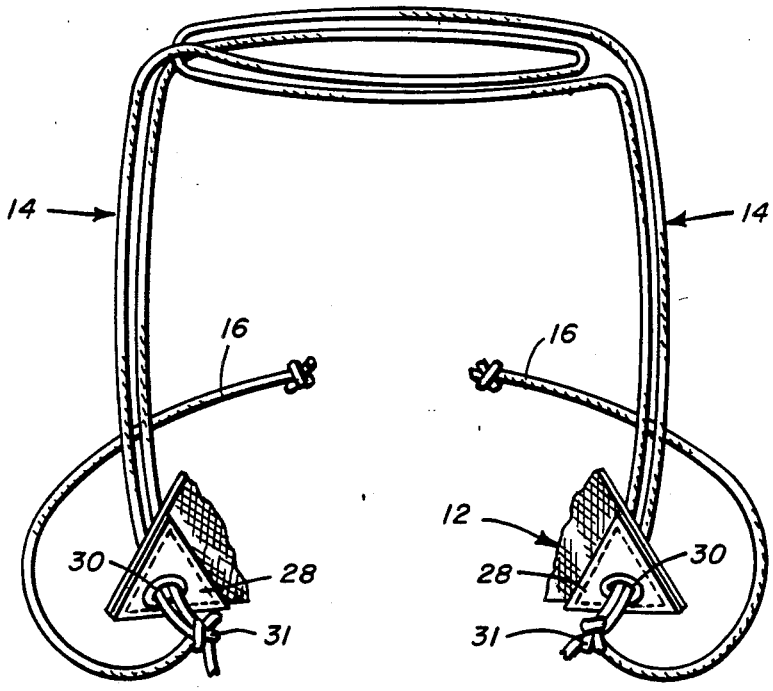
FIG. 5 is a schematic representation of the basic arrangement of the cords which define the shoulder straps and waist straps.
Figure 2:
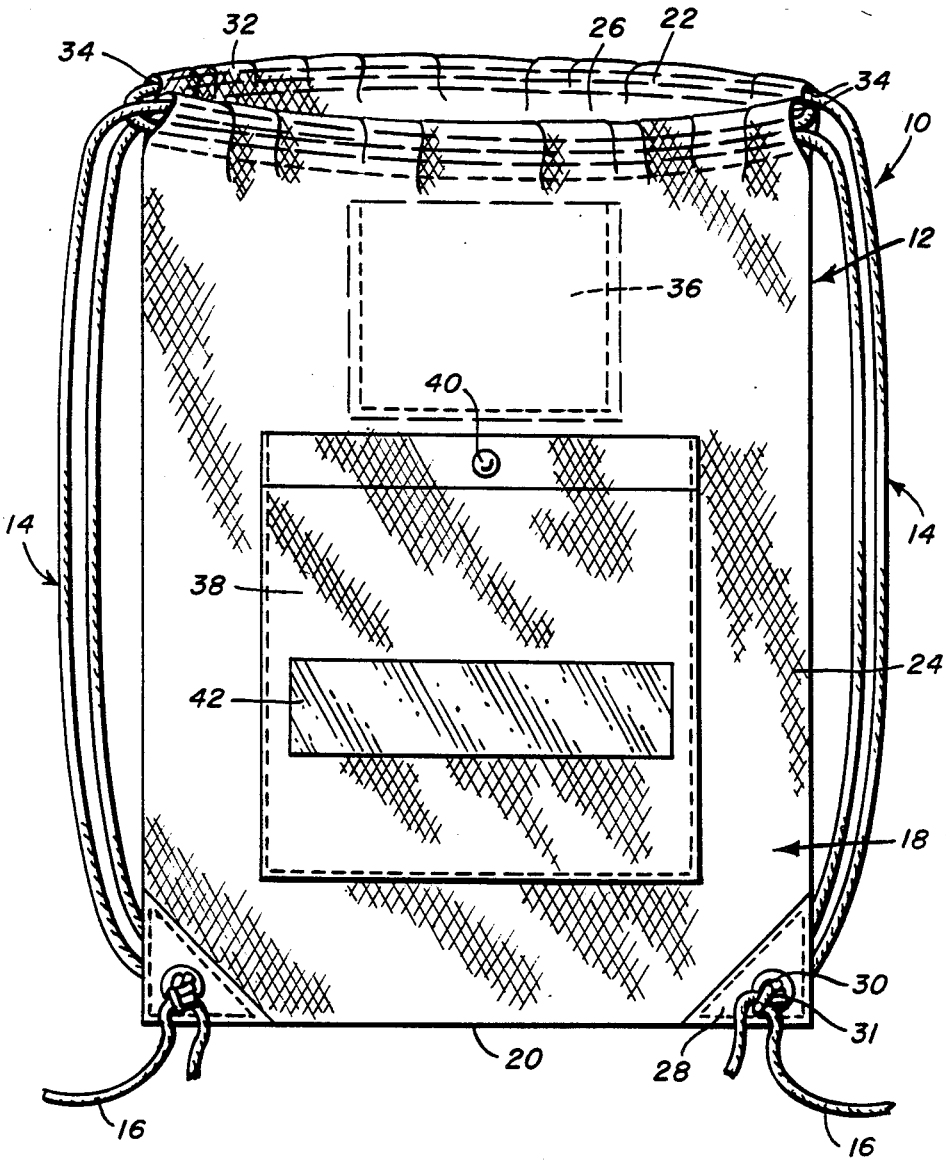
FIG. 2 is an enlarged front elevational view of the backsack.
Figure 3:
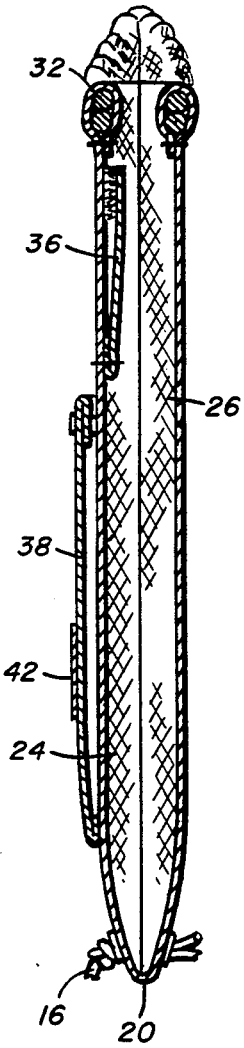
FIG. 3 is a vertical cross section taken centrally through the pouch of FIG. 2.
Figure 4:
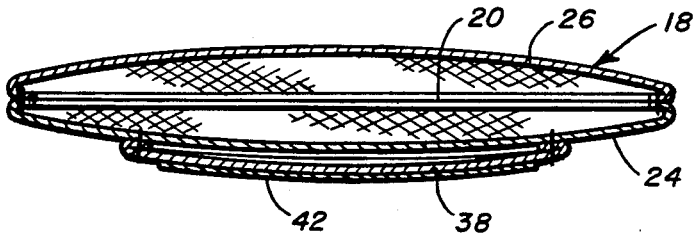
FIG. 4 is a horizontal cross section taken centrally through the pouch of FIG. 2.

Referring now to the shoulder straps 14 and noting FIGS. 2 and 5 in particular, each strap 14 is an oppositely directed duplicate of the other strap and is basically defined by a single cord looped about the open top 22 of the pouch 12, through the sleeve 32, out one of the openings 34, and loosely depending vertically along the height of the pouch 12. The lower end portion of the looped cord of each strap 14 is received through one of the grommeted apertures 30 and provided with an appropriate stop, such as a knot 31, to preclude retraction back through the aperture. Each double length of cord between the sleeve received looped upper end thereof and the aperture received lower end defines a shoulder sling for accommodation of the arm and shoulder of a wearer.

Each of the strap defining cords, beyond the lower apertures, extends for a length sufficient to define the waist cord or strap 16.

In use, the open upper end of the pouch 12 is closed by a contracting of the flexible upper portion of the peripheral wall 18. This is effected by an outward drawing of the looped, sleeve-received upper portions of the straps 14 relative to each other. The outward pull on the shoulder straps can be effected either independently of or simultaneously with a mounting of the backsack in that an introduction of the arms and shoulders through the defined shoulder slings will inherently cause an extension of the straps and a corresponding contracting of the bag opening, particularly inasmuch as the lower ends of the defined loops are retained against retraction through the grommeted openings 30.

Once mounted on the shoulders, the waist cords or straps 16 are tightly drawn forwardly about the waist of the user and appropriately tied. This drawing of the waist straps 16 about the waist will simultaneously tend to shorten the sling portions of the straps and snugly engage the backsack and straps against the body of the user. Such an action will of course also maintain tension on the straps and enhance the contraction or closure of the opening, thereby precluding any accidental opening of the pouch regardless of the extent of movement of the wearer, whether jogging, skiing, or the like.

It is also to be appreciated that the interaction between the closure, shoulder straps, waist straps and pouch itself is such as to snugly engage the entire assembly to the body of the user with the pouch being positively anchored along the entire extent of the upper end thereof and at the lower corners. Secured in this manner, and constructed to strong lightweight material, there will be no tendency for the backsack to move, bounce or chafe. As such, the backsack of the invention is particularly adapted for use by joggers or runners. Similarly, the mesh-like nature of the preferred material allows the pouch itself to closely adjust to the contents and "breathe". When empty, it is contemplated that the entire backsack be foldable within the outer pocket 38 for convenient storage.

I claim:

1. A backsack comprising a pouch and a pair of opposed shoulder straps, said pouch including a peripheral wall, a closed bottom and an open top, said peripheral wall including an upper section defining said open top, said upper section being selectively inwardly contractable to close said open top, separate cooperating closure means, one on each shoulder strap, engaged with said upper section for a contraction of said upper section in response to an outward movement of said shoulder straps relative to each other, aperture means on said pouch adjacent said closed bottom, each shoulder strap having a lower end thereof remote from the closure means engaged through said aperture means, each said shoulder strap defining a shoulder receiving sling between the lower end thereof and the corresponding closure means, and a pair of waist lines, each of said waist lines defining an extension of one of the shoulder straps beyond the aperture means, said waist lines extending from said pouch at the lower ends of said shoulder straps for outward movement relative to the aperture means and for tying engagement about the waist of a wearer, each of said shoulder straps being freely outwardly movable through the aperture means upon outward movement of the waist lines for a contraction of the shoulder receiving slings.

2. The backsack of claim 1 including limit means on each said shoulder strap limiting retraction of said shoulder strap lower ends through said aperture means upon outward movement of said shoulder straps relative to each other while allowing the free outward movement of said shoulder straps through said aperture means upon outward movement of said waist lines.

3. The backsack of claim 2 wherein said closure means of each of said shoulder straps comprises a loop encircling said upper section, the loops on said pair of shoulder straps being oppositely directed and in overlying relation to each other, and retaining means on said upper section of the wall slidably receiving said loops therethrough.

4. The backsack of claim 3 wherein said retaining means comprises a sleeve defined from said upper section about said open top, said sleeve having a pair of opposed openings aligned with said shoulder straps.

5. The backsack of claim 3 wherein each shoulder strap and corresponding waist line comprises a single length of cord, a portion of said length of cord being folded on itself to define the corresponding loop and knotted beyond said aperture means to define said limit means.

6. The backsack of claim 1 wherein said closure means of each of said shoulder straps comprises a loop encircling said upper section, the loops on said pair of shoulder straps being oppositely directed and in overlying relation to each other, and retaining means on said upper section of the wall slidably receiving said loops therethrough.

7. The backsack of claim 6 wherein said retaining means comprises a sleeve defined from said upper section about said open top, said sleeve having a pair of opposed openings aligned with said shoulder straps.

* * * * *